United States Patent [19]

Dellutri

[11] Patent Number: 4,620,937

[45] Date of Patent: Nov. 4, 1986

[54] ALL PURPOSE CLEANER CONTAINING D-LIMONENE

[76] Inventor: Joseph Dellutri, 742 E. 85th St., Brooklyn, N.Y. 11236

[21] Appl. No.: 700,121

[22] Filed: Feb. 11, 1985

[51] Int. Cl.[4] ..... C11D 3/18; C11D 3/20; C11D 3/382; C11D 3/43

[52] U.S. Cl. ..... 252/143; 134/38; 134/40; 252/89.1; 252/132; 252/162; 252/170; 252/173; 252/174.21; 252/DIG. 1; 252/DIG. 5; 252/DIG. 8; 252/DIG. 13; 252/DIG. 14

[58] Field of Search ..... 252/89.1, 122, 132, 252/162, 170, 172, 173, 174.21, DIG. 1, DIG. 5, DIG. 13, DIG. 14, 142, 143

[56] References Cited

U.S. PATENT DOCUMENTS

| | | | |
|---|---|---|---|
| 3,933,674 | 1/1976 | Farnsworth | 252/171 |
| 4,336,152 | 6/1982 | Like | 252/106 |
| 4,362,638 | 12/1982 | Caskey | 252/90 |
| 4,414,128 | 11/1983 | Goffinet | 252/111 |
| 4,438,009 | 3/1984 | Brusky | 252/90 |
| 4,511,488 | 4/1985 | Matta | 252/162 |
| 4,533,487 | 8/1985 | Jones | 252/170 |

FOREIGN PATENT DOCUMENTS

| | | |
|---|---|---|
| 3144168 | 5/1983 | Fed. Rep. of Germany . |
| 1603047 | 11/1981 | United Kingdom . |

OTHER PUBLICATIONS

Coleman, Richard L., "D-Limonene as a Degreasing Agent", *The Citrus Industry,* Nov. 1975, pp. 23–25.

Veragel, bulletin No. 3M78-1501 & 1504, published by Dr. Madis Laboratories, Inc., South Hackensack, New Jersey, 1978, pp. 10 & 17.

*Primary Examiner*—Dennis L. Albrecht

*Attorney, Agent, or Firm*—Goodman & Teitelbaum

[57] ABSTRACT

A cleaning agent for use as an industrial heavy duty cleaner, as well as being a hand cleaner and an all purpose cleaner. The cleaning agent has citric oil as its basic ingredient, and preferably includes a distilled, stabilized citric oil mixture including distilled D-Limonene, stearic and oleic acids, and a non-ionic detergent. Additionally, Aloe Vera juice and/or vinegar can also be included in the cleaning agent.

9 Claims, No Drawings

ALL PURPOSE CLEANER CONTAINING D-LIMONENE

BACKGROUND OF THE INVENTION

This invention relates to cleaning agents, and more particularly to a cleaning agent having a citric oil composition for industrial cleaning, which can also be used as a hand cleaner as well as being an all purpose cleaner.

There are many detergents readily available for specified purposes. For example, industrial cleaners are available for heavy duty cleaning such as for removing graffiti, grease, paint, and similar stains and grime. These heavy duty cleaners generally include strong ingredients which may be irritating to the user's skin, and may even be hazardous and toxic. In addition, because of the active ingredients provided in these heavy duty industrial cleaners, not only do they remove the graffiti, grease, and grime, but they may also remove the original paint or surface coating on the object being cleaned.

At the opposite extreme, there are cleaning agents which are extremely mild for only light cleaning, such as finger marks and smudges, thereby avoiding irritation and toxicity. Additionally, there are some cleansers that are specifically designed for use as a hand cleaner, where these contain only very mild ingredients and even include ingredients to enhance the softness and texture of the user's hand.

What is needed, however, is a non-toxic type of cleaning agent which can provide heavy duty industrial cleaning, such as for graffiti removal, while at the same time being mild enough not to irritate the user's skin. Furthermore, it would be even more effective if this cleaning agent would be mild enough for use as a hand cleaner, as well as being an all purpose cleaner to solve all the user's cleaning needs for both indoor and outdoor areas, such as for appliances, cabinets, walls, floors, etc. in the kitchen, sink, tub, tiles, etc. in the bathroom, and carpet, upholstery, clothing, luggage, blinds, shades, storm doors and windows, etc. in other areas, as well as being a pet cleaner.

SUMMARY OF THE INVENTION

Accordingly, it is an object of the present invention to provide an improved all duty cleaning agent useful for heavy duty cleaning as well as being both a hand cleaner and an all purpose cleaner which can be used on pets.

Another object of the present invention is to provide a cleaning agent which can be used as a heavy duty cleaner for removing paint, graffiti, grime, grease, etc., and will not damage the originally treated surface being cleaned.

A further object of the present invention is to provide a cleaning agent which is mild enough to be utilized as a hand cleaner, and will enhance the fragrance of the user's hands during its cleaning action, in addition to being utilized as an all purpose cleaner.

Yet a further object of the present invention is to provide a cleaning agent having a citric oil as its basic ingredient, which not only provides for heavy duty cleaning, but is also non-toxic, non-irritating, and useful for enhancing cleaning of the user's hands and pets, as well as being an all purpose cleaner.

Briefly, in accordance with the present invention, there is provided a cleaning agent comprising a mixture of distilled, stabilized citric oil with water. The citric oil can typically include distilled D-Limonene, stearic and oleic acids, and non-ionic detergents. The mixture can be further enhanced with a slight amount of juice from the Aloe Vera plant and/or vinegar. Also, lanolin and surfactants can be added to improve the hand cleaning aspect of the present invention.

DESCRIPTION OF THE PREFERRED EMBODIMENT

A cleaning agent is provided which has a citric oil as its basic ingredient. The citric oil can be further combined with various other ingredients to enhance its usefulness as a cleaning agent.

In a particular embodiment of the present invention, the citric oil is mainly distilled D-Limonene. Additionally, stearic and oleic acids, and also non-ionic detergents can be included in the citric oil.

In a preferred embodiment of the present invention, it has been found that the citric oil should be distilled and stabilized, and should be between 20% and 90% of the liquid volume of the cleaning agent mixture with approximately 75% being found as being most effective. The balance of the liquid mixture is mainly water, so that 25% of the mixture is water when the citric oil is at its preferred content of 75%.

The distilled, stabilized citric oil includes distilled D-Limonene as its main ingredient to provide the cleaning power to the cleaning agent, with a minimum of 50% of the distilled D-Limonene being included in the distilled, stabilized citric oil. Preferably, an 80% content of the distilled D-Limonene has been found most effective. The other ingredients of the distilled, stabilized citric oil include stearic and oleic acids. These fatty acids are stabilizers for the purpose of blending the citric oil together. Up to 25% of the distilled stabilized citric oil can be such acids, where preferably about a 10% content of the acids has been found most effective. The balance of the distilled, stabilized citric oil includes non-ionic detergents, where any suitable well known non-ionic detergents can be used. These non-ionic detergents add to the cleaning power, and also aid in the mixing of the citric oil with the water so as to accelerate the cleaning power of the distilled D-Limonene. Up to 25% of the stabilized, citric oil can be such no-ionic detergents where preferably a 10% content of the non-ionic detergents has been found most effective.

In summary, the preferred cleaning agent includes:

| | % of citric oil | % of cleaning agent | % of cleaning agent |
|---|---|---|---|
| 1. Distilled, stabilized citric oil composed of: | | | 75% |
| a. Distilled D-Limonene | 80% | 60% | |
| b. Stearic and Oleic Acids | 10% | 7.5% | |
| c. Non-ionic detergent | 10% | 7.5% | |
| 2. Water | | | 25% |

Using the above combination of basically organic ingredients, the cleaning agent has been found most useful in heavy duty cleaning such as for the removal of graffiti, paint, grime, grease, etc. from walls, and other surfaces. Although the cleaning agent easily cleans off the dirt and unwanted material, it does not harm the original surface coating from which the dirt and unwanted material are removed.

This combination has been found to be practically nontoxic. Tests have shown that the cleaning agent can be taken internally without harm. The cleaning agent is not a primary irritant. However mild irritation with prolonged repeated contact might occur, such as becoming an eye irritant.

The cleaning agent has been found extremely effective as an all purpose cleaner for cleaning dirt and grime from all types of surfaces including carpets, upholstery, clothing, leather, venetian blinds, shades, and storm doors and windows. It could also be used on hard surfaces, such as appliances, walls, floors, formica, Sanitex, vinyl, wood panels, steel, chrome and aluminum. Yet, other surfaces can also be cleaned.

Optionally, vinegar can be added to the cleaning agent mixture. A slight amount of vinegar, approximately 0.11% of cleaning agent mixture, to reduce the odor of the citric acid. Furthermore, the vinegar adds lustre to the finish of the cleaned surface, particularly when such surfaces are aluminum or other metals. Accordingly, to a 55 gallon drum container of the cleaning agent mixture, 4 ounces of vinegar would be added.

Optionally, the juice of Aloe Vera plants can also be added to the cleaning agent mixture, where approximately 0.91% of the mixture would be Aloe Vera juice. This Aloe Vera juice serves to protect the user's hands when using the cleaning agent, and reduces the risk of any irritation to the user's skin. The Aloe Vera juice is particularly useful when the cleaning agent is used as a hand cleanser and/or pet cleaner, such as for dogs and cats. Accordingly, to a 55 gallon drum container of the cleaning agent mixture, approximately 1 quart of the Aloe Vera juice would be added. The Aloe Vera juice is a readily available product sold by Don M. Corporation of Tyler, Tex. The Aloe Vera juice is essentially a vitamin based material containing minerals and other active ingredients including amino acids and many enzymes.

When the cleaning agent comprising the citric oils are combined with the water and the Aloe Vera juice, where possibly preselected amounts of surfactants, stabilizers and lanolin may also optionally be included as required, the cleaning agent can be effectively utilized as a hand cleaner. The hand cleaner is substantially unique in that it also serves as a heavy duty cleaner for industrial and all purpose use, where the hand cleaner leaves the hands with a pleasant citrus flavor, a natural softness, and a refreshing fragrance. Furthermore, the hand cleaner can remove soiled ingredients from the hands including oil, grease, paint, tar, ink, adhesives, grass and fruit stains, etc.

A sample of the material was tested at a chemical laboratory and found to have a specific gravity of 0.835 and a flash point of approximately 150 degrees Fahrenheit. The sample had approximately 19% of alcohol soluble solids (soap and surfactants), no alcohol insoluble solids, no free alkali and no prohibited solvents. It has a pH of 5.5 and a gelatinous consistency. It had no apparent detrimental effect when tested for two hours at room temperature on numerous materials such as aluminum, anodized aluminum, steel, rubber, fiberglass, glass, acrylics and urethene paint.

There has been described heretofore the best embodiment of the invention presented contemplated. However, it is to be understood that various changes and modifications may be made thereto without departing from the spirit of the present invention.

What is claimed is:

1. A cleaning agent comprising:

a liquid mixture of distilled, stabilized citric oil, vinegar and water;

said distilled, stabilized citric oil being between 20% and 90% by volume of said mixture;

said distilled, stabilized citric oil including distilled D-Limonene, fatty acids, and a non-ionic detergent to add to and accelerate cleaning effect of said distilled D-Limonene;

said D-Limonene being at least 50% by volume of said distilled, stabilized citric oil;

said fatty acids including stearic and oleic acids to blend said distilled, stabilized citric oil together, said fatty acids being between 10% and 25% by volume of said distilled, stabilized citric oil;

said non-ionic detergent being between 10% and 25% by volume of said distilled, stabilized citric oil; and said vinegar being approximately 0.11% by volume of said mixture.

2. A cleaning agent as in claim 1, wherein said distilled, stabilized citric oil is approximately 75% by volume of said mixture.

3. A cleaning agent as in claim 1, wherein said distilled, D-Limonene is approximately 80% by volume of said distilled, stabilized citric oil.

4. A cleaning agent as in claim 1, wherein said fatty acids are approximately 10% by volume of said distilled, stabilized citric oil.

5. A cleaning agent as in claim 1, wherein said non-ionic detergent is approximately 10% by volume of said distilled, stabilized citric oil.

6. A cleaning agent as in claim 1, wherein said distilled D-Limonene is approximately 80%, said fatty acids are approximately 10%, and said non-ionic detergent is approximately 10% by volume of said distilled, stabilized citric oil.

7. A cleaning agent as in claim 1, wherein said mixture additionally includes Aloe Vera juice, said Aloe Vera juice being approximately 0.91% by volume of said mixture.

8. A cleaning agent as in claim 7, wherein said distilled, stabilized citric oil is approximately 75% by volume of said mixture.

9. A cleaning agent as in claim 6, wherein said mixture additionally includes Aloe Vera juice, said Aloe Vera juice being approximately 0.91% by volume of said mixture.

* * * * *